US007057585B2

(12) United States Patent
Kang et al.

(10) Patent No.: US 7,057,585 B2
(45) Date of Patent: Jun. 6, 2006

(54) SETTING METHOD FOR AVERAGE PICTURE LEVEL AND METHOD OF DRIVING PLASMA DISPLAY PANEL USING THE SAME

(75) Inventors: Bong Koo Kang, Pohang-shi (KR); Seong Ho Kang, Daegu (KR); Bon Cheol Koo, Daegu (KR)

(73) Assignee: LG Electronics Inc., Seoul (KR)

( * ) Notice: Subject to any disclaimer, the term of this patent is extended or adjusted under 35 U.S.C. 154(b) by 322 days.

(21) Appl. No.: 10/305,080

(22) Filed: Nov. 27, 2002

(65) Prior Publication Data

US 2003/0098824 A1 May 29, 2003

(30) Foreign Application Priority Data

Nov. 28, 2001 (KR) ..... 10-2001-74478

(51) Int. Cl.
*G09G 3/28* (2006.01)

(52) U.S. Cl. ..... 345/60; 345/63; 345/68; 345/77; 345/212; 348/686; 348/687

(58) Field of Classification Search ..... 345/60, 345/63, 68, 77, 89, 212, 673; 348/686, 687
See application file for complete search history.

(56) References Cited

U.S. PATENT DOCUMENTS 5,956,014 A * 9/1999 Kuriyama et al. ..... 345/690
6,072,448 A * 6/2000 Kojima et al. ..... 345/63
6,104,362 A * 8/2000 Kuriyama et al. ..... 345/63
6,278,436 B1 * 8/2001 Hosoi et al. ..... 345/30
6,326,938 B1 * 12/2001 Ishida et al. ..... 345/63
6,462,721 B1 * 10/2002 Kasahara et al. ..... 345/63

FOREIGN PATENT DOCUMENTS

JP 02000010522 * 1/2000

* cited by examiner

*Primary Examiner*—Amr A. Awad
*Assistant Examiner*—Vincent E. Kovalick
(74) *Attorney, Agent, or Firm*—Fleshner & Kim, LLP

(57) ABSTRACT

A method may be provided for setting an average picture level. This may include setting an average picture level with a fixed number of steps based on a pre-determined gray level range, deriving a low brightness intensifying coefficient, deriving a high brightness intensifying coefficient, deriving a first constant representing an average increase rate of brightness, and calculating a number of sustain pulses corresponding to a gray level of a video signal currently inputted based on the derived low brightness intensifying coefficient, the derived high brightness intensifying coefficient and the derived first constant.

25 Claims, 7 Drawing Sheets

REPLACEMENT SHEET

SETTING METHOD FOR AVERAGE PICTURE LEVEL AND METHOD OF DRIVING PLASMA DISPLAY PANEL USING THE SAME

BACKGROUND OF THE INVENTION

1. Field of the Invention

This invention relates to a plasma display panel, and more particularly to a method of setting an average picture level that is adaptive for preventing a brightness inversion phenomenon and a method of driving a plasma display panel using the same.

2. Description of the Related Art

A plasma display panel PDP is a display device using a phenomenon that visible ray is generated from a fluorescent substance when ultraviolet ray generated by gas discharge excites the fluorescent substance. The PDP is thinner and lighter than a cathode ray tube CRT, which has been used as main display means so far, and can be embodied of high definition and wide screen.

Referring FIG. 1, a discharge cell of a three-electrodes AC surface discharge PDP includes a first electrode Y and a second electrode Z formed on an upper substrate 1, and an address electrode X formed on a lower substrate 4.

The address electrode perpendicularly intersects a pair of sustain electrodes each including either the first electrode Y or the second electrode Z.

There are a dielectric layer 2 and a protective film 3 deposited on the upper substrate to cover the first electrode Y and the second electrode Z.

There is a dielectric layer 5 deposited on the entire surface of the lower substrate 4 to cover the address electrode X and there are barrier ribs 6 formed parallel to the address electrode X on top of it.

There is inactive mixture gas as discharge gas interposed into a discharge space of a discharge cell provided between the upper/lower substrates 1 and 4 and the barrier ribs 6.

In order to realize gray level of a picture, there is a frame (field) driven by being divided into several sub fields that have different light-emission frequency. Each sub field is divided into a reset interval (or initialization interval) for initializing cells of a whole screen, an address interval for selecting the cell and a sustain interval for realizing the gray level in accordance with a discharge frequency, then to be driven.

FIG. 2 illustrates a driving apparatus of a conventional plasma display panel.

Referring to FIG. 2, the conventional driving apparatus of the PDP includes a first reverse gamma corrector 10A connected between an input line 9 and the PDP 26, a gain controller 12, an error diffuser 14, a sub-field mapping unit 16 and a data aligner 18; a frame memory 20 connected between the input line 9 and the PDP 26, a second reverse gamma corrector 10B, an average picture level APL controller 22 and a waveform generator 24.

The first and the second reverse gamma corrector 10A and 10B applies reverse gamma correction to a gamma corrected video signal to linearly convert the brightness value depending on the gray scale value of a video signal. The frame memory 20 stores the data R,G,B of one frame portion and supplies the stored data to the second reverse gamma corrector 10B.

The APL controller 22 receives the video data corrected by the second reverse gamma corrector 10B to generate N (N is an integer) step signals for controlling the number of sustaining pulses. The gain controller 12 amplifies the corrected video data from the first reverse gamma corrector 10A as much as effective gain.

The error diffuser 14 diffuses an error component of a cell to the adjacent cells to finely control the brightness value. The sub-field mapping unit 16 re-allots the video data corrected from the error diffuser 14 by sub-fields.

The data aligner 18 converts the video data inputted from the sub-field mapping unit 16 to be suitable for the resolution format of the PDP 26, and then supplies to an address driving integrated circuit IC of the PDP 26.

The waveform generator 24 generates a timing control signal by the inputted N step signal from the APL controller 22 and supplies the generated timing control signal to the address driving IC, a scan driving IC and a sustain driving IC of the PDP 26.

In this way, the APL controller 22 of the driving apparatus of the conventional plasma display panel is used to emphasize the area that is relatively bright when the luminosity of the whole image is dark.

There is an operation process of the APL controller 22 explained in detail in reference to FIG. 3.

Referring to FIG. 3, the number of sustain pulses decreases as the step of APL gets higher. In other words, when the APL step is below a threshold APLth (to be set approximately between 17 to 24), the number of sustain pulses is set to be the maximum sustain number (approximately between 800 to 1200). When the APL step is over the threshold APLth, the number of sustain pulses gradually diminishes. Here, when the APL step is maximal, the number of sustain pulses is set to be the minimum sustain number (approximately near 200).

On the other hand, power consumption increases in proportion to APL when the APL is below the threshold APLth, and is uniformly maintained on the whole when the APL is over the threshold APLth. That is, the APL controller 22 of the conventional PDP is used in order to emphasize the relatively bright area when the luminosity of the whole image is dark and to have the power consumption maintained uniformly.

On the other hand, the number of sustain pulses in accordance with APL steps is determined by the following Equation 1.

$$Nsus=1/(a+b\times x) \quad \text{[Equation 1]}$$

Herein, x represents a current APL step, Nsus denotes the number of sustain pulses. And, a and b can be determined from a maximum sustain number, an APL threshold Ath, a minimum sustain number and a maximum APL step.

For instance, a linear equation in relation to a and b can be calculated by setting the maximum sustain number to be 1200 (Nsus=1200) and the threshold APLth of APL to be 17 (x=17). Further, quadratic equation can be calculated by setting the minimum sustain number to be 182 (Nsus=182) and the maximum APL step to be 255 (x=255). If the value of a and b is calculated in use of the linear equation and the quadratic equation, a has the value of $4.9\times10^{-4}$ and b has the value of $1.96\times10^{-5}$.

At this moment, by the Equation 1, the number of sustain pulses Nsus is set to be 680.2721 . . . if the APL is 50, and the number of sustain pulses Nsus is set to be 408.1632 . . . if the APL is 100. Further, the number of sustain pulses Nsus is set to be 226.7573 if the APL is 200. In other words, the conventional APL controller 22 determines the number of sustain pulses by rounding off a fraction below a decimal point in use of Equation 1.

There is explained how to derive Equation 1 in reference to FIG. 4.

Referring to FIG. 4, a conventional equivalent circuit of a PDP includes a first capacitors Cd formed between the first Y and second Z electrodes and the address electrode X respectively, a second capacitor Cg formed by a gap between the first electrode Y and the second electrode Z, a third capacitor Cdi formed by the dielectric layers 2 and 5, a fourth capacitor formed by a plasma and a inactive gas, a first resistor formed by the resistance value of the plasma, a second resistor Rd formed by a data driver and a third resistor Re formed by a scan driver.

In such an equivalent circuit of a conventional PDP, a first electric power P1 consumed in a panel is proportional to the multiplication of the number of sustain and a current APL step (P1∝Nsus×x). Further, a reactive power P2 that charges the capacitors Cd, Cg, Cdi and Cv formed in the panel is proportional to the number of sustain (P2∝Nsus).

A second electric power P3 consumed in an energy recovering device for recovering the electric power supplied to the first and second electrodes is proportional to the reactive power P2 (P3∝P2∝Nsus). A third electric power P4 consumed by internal resistance in a power supplier that supplies electric power to the panel and the energy recovering device is proportional to the sum of the first electric power P1 and the second electric power P3 (P4∝P1+P3∝Nsus(K+Kx)).

Accordingly, the consumed power in the whole PDP is defined as Equation 2.

$$P\text{tot} \propto \text{P1}+P3+P4 \propto N\text{sus}(a+b\times x) \quad \text{[Equation 2]}$$

At this moment, an average brightness of a screen is determined by Equation 3.

$$B \propto N\text{sus}\times\text{x} \quad \text{[Equation 3]}$$

Even if the APL step changes in Equation 2, a maximum sustain number needed for sustaining power consumption uniformly is as the followings.

$$N\text{sus}(x)=k/(a+bx) \quad \text{[Equation 4]}$$

Herein, Equation 1 is derived since k is set to be 1. On the other hand, when the maximum number of sustain is 1200 (Nsus=1200) and the threshold APLth of the APL is 17 (x=17), if the brightness of B(x)−B(x−1)-herein, x is a natural number of 1 or more-is calculated in use of Equation 3, it can be shown as in FIG. 5.

In other words, FIG. 5 is a graph represented by subtracting the brightness value of a previous APL step from the brightness value of a current APL step.

Referring to FIG. 5, it can be seen that the brightness is inverted when setting the number of sustain pulses when using a conventional Equation 1. In other words, there is shown an area where the brightness is inverted (where values are below '0' in a Y axis) when the APL step is over 120. Such a brightness inversion phenomenon takes place by rounding off a fraction below a decimal point when calculating the number of sustaining pulses with Equation 1. On the other hand, if the brightness is inverted in the PDP, flicker phenomenon may occur, thereby causing picture quality deterioration.

SUMMARY OF THE INVENTION

Accordingly, it is an object of the present invention to provide a method of setting an average picture level that is adaptive for preventing a brightness inversion phenomenon and a method of driving a plasma display panel using the same.

In order to achieve these and other objects of the invention, a method of setting an average picture level according to an aspect of the present invention includes setting an average picture level with a fixed number of steps on the basis of a pre-determined gray level range; deriving a low brightness intensifying coefficient from a low brightness range of steps that are not greater than a middle step of the average picture level in order to correct a linearity of brightness; deriving a high brightness intensifying coefficient from a high brightness range of steps that are equal to or not less than the middle step in order to correct a brightness inversion phenomenon; deriving a first constant representing an average increase rate of brightness in relation to an increase of the average picture level when a current average picture level increases as compared to a previous average picture level; and calculating the number of sustain pulses corresponding to a gray level of a video signal currently inputted in use of the derived low brightness intensifying coefficient, the high brightness intensifying coefficient and the first constant.

The method further includes a step of setting a maximum sustain pulse number and a minimum sustain pulse number;

The method further includes a step of setting a second constant and a third constant in use of the following Formula 1 after receiving a threshold of average picture level that makes the maximum sustain pulse number sustained uniformly, the minimum sustain number and a maximum step value of the average picture level;

$$N=1/(a+b\times x1) \quad \text{Formula 1}$$

Herein, N is the maximum sustain pulse number of the minimum sustain pulse number, a is the second constant, b is the third constant and x1 is the threshold or the maximum step value.

The sustain pulse number is determined by the following Formulas 2 and 3;

$$N\text{sus}(x)=n(x)/(a+bx) \quad \text{Formula 2}$$

$$N(x)=((a+bx)/x)\times[d\times ln(x)+e(x-i)+f(x-i)^2] \quad \text{Formula 3}$$

Herein, x is the current average picture level, Nsus(x) is the number of sustain pulses determined by the current average picture level, d is the low brightness intensifying coefficient, e is the first constant, f is the high brightness intensifying coefficient and i is the middle step of the average picture level.

The method further includes a step of setting a maximum power value and a minimum power value of the plasma display panel on the basis of an average power value of a power supply for supplying electric power.

The maximum power value is obtained by adding the average power value and 5%~25% of the average power value.

The minimum power value is obtained by subtracting 5%~25% of the average power value from the average power value.

The method includes steps of inputting the lower intensifying coefficient d, the first constant e and the higher intensifying coefficient f, which are pre-determined, into the Formulas 2 and 3; and increasing the low brightness intensifying coefficient by "1" until it satisfies the maximum sustain pulse number after inserting the threshold of the average picture level into the Formulas 2 and 3.

In the method, the first constant is made to increase by "1" until a high brightness value is obtained in a high average picture level if the maximum sustain pulse number is satisfied when the threshold of the average picture level is inputted into the Formulas 2 and 3.

In the method, the value of the first constant is made to decrease by "1" and the low brightness intensifying coefficient is made to increase by "1" in order to allow a power value currently consumed in the plasma display panel to be positioned between the maximum power value and the minimum power value.

In the method, the value of the high brightness intensifying coefficient is made to increase by "0.01" until the high brightness value is obtained in the high average picture level after the first constant and the low brightness intensifying coefficient are adjusted.

The low brightness intensifying coefficient, the first constant and the high brightness intensifying coefficient are substituted into the Formulas 2 and 3, and determined if they satisfy the following Conditions 1, 2 and 3;

$$N(x2)=N(\max) \qquad \text{Condition 1}$$

Herein, N(x2) is the threshold of the average picture level and N(max) is the maximum sustain pulse number.

$$B(x)-(Bx-1)>0 \qquad \text{Condition 2}$$

Herein, B(x) is a brightness value of the current average picture level, B(x−1) is a brightness value of the previous average picture level.

$$P1<P(x)<P2 \qquad \text{Condition 3}$$

Herein, P1 is a minimum power value, P2 is a maximum power value and P (x) is a power value of the current average picture level.

The first constant and the high brightness intensifying coefficient are set to be minimum values that satisfy the Condition 1 to 3.

A method of setting an average picture level according to another aspect of the present invention includes steps of detecting a value of a current average picture level; subtracting a middle value of an average picture level from the value of the current average picture level; and calculating the number of sustain pulses corresponding to the value of the current average picture level in use of the subtracted value.

A method of driving a plasma display panel according to still another aspect of the present invention includes steps of detecting a value of a current average picture level; subtracting a middle value of an average picture level from the value of the current average picture level; and calculating the number of sustain pulses corresponding to the value of the current average picture level in use of the subtracted value, and wherein the sustain pulse are applied to the plasma display panel as many as the calculated number of the sustain pulses.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

With reference to FIGS. 6 to 10, there are explained preferred embodiments of the present invention as follows.

According to an embodiment of the present invention, the number of sustain pulses in accordance with APL steps is determined by the following Equation 5 and 6.

$$N\text{sus}(x)=n(x)/(a+bx) \qquad \text{[Equation 5]}$$

Herein, $$n(x)=((a+bx)/x)\times[d\times ln(x)+e\times(x-128)+f\times(x-128)^2] \qquad \text{[Equation 6]}$$

Herein, a constant d is used as a low brightness intensifying coefficient for improving linearity of brightness when an APL step (x) is not greater than half of the maximum step. A constant f is used as a high brightness intensifying coefficient for preventing a brightness inversion phenomenon when an APL step (x) is half of the maximum step or greater. A constant e is a value representing an average increase rate of brightness in accordance with APL increase.

Figure 1:
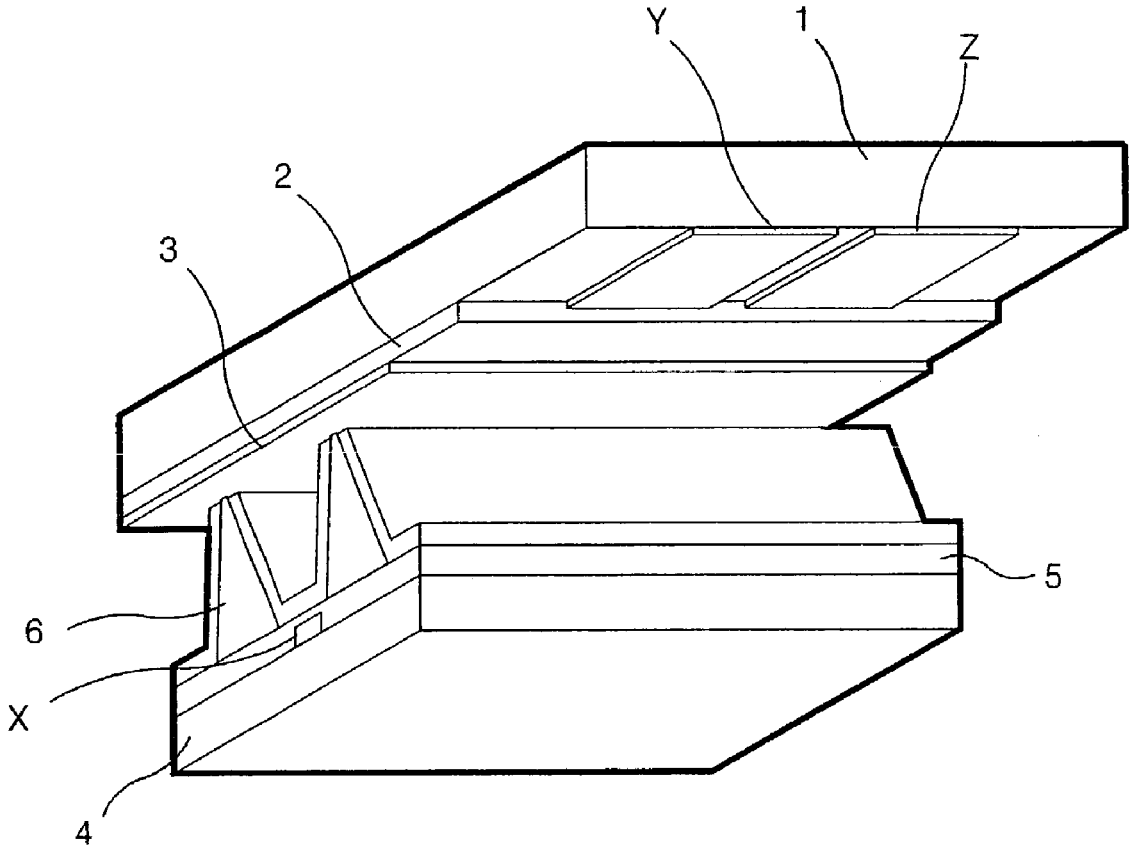
FIG. 1 RELATED ART
FIG. 1 illustrates a perspective view of a discharge cell structure of a conventional three-electrodes AC surface discharge plasma display panel.
Figure 2:
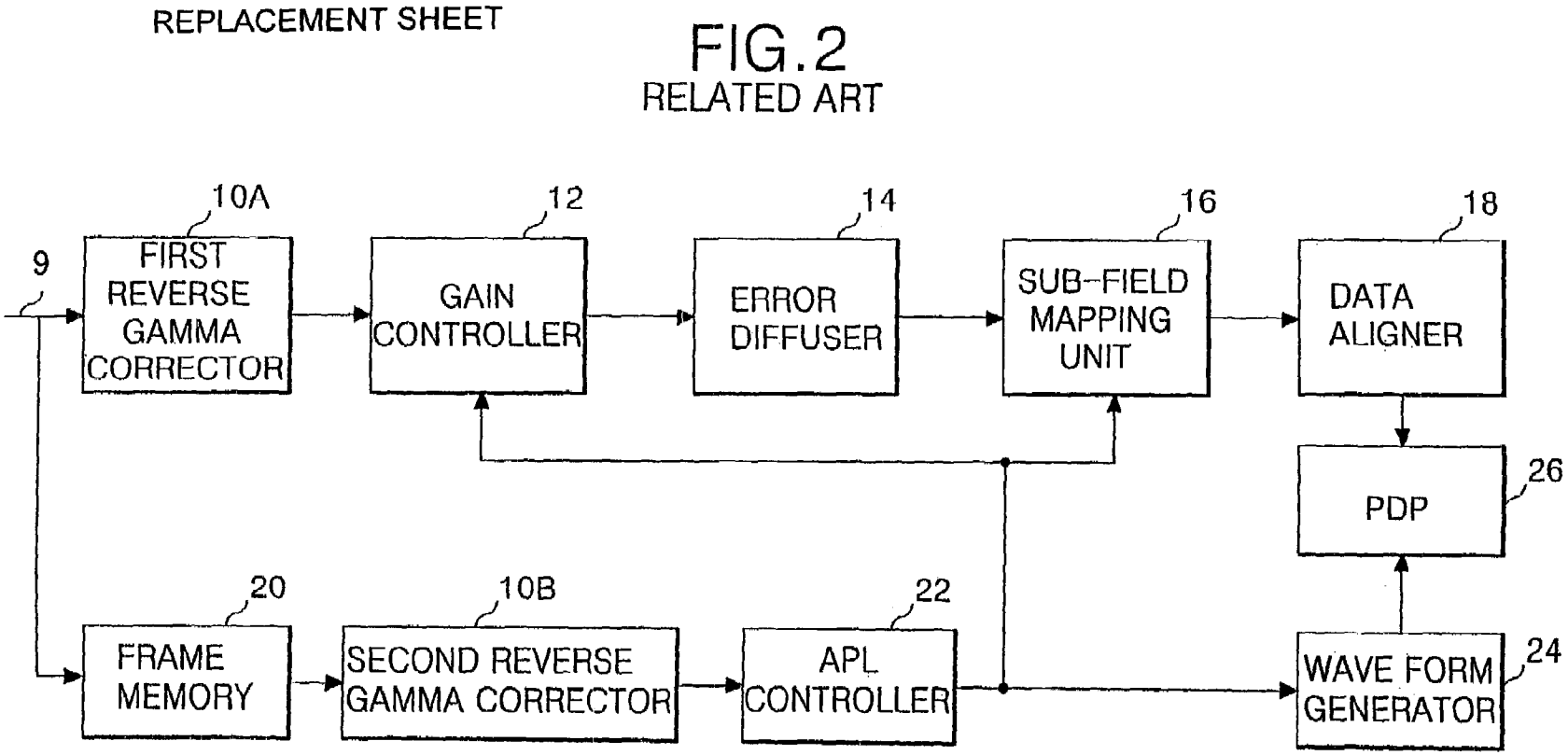
FIG. 2 RELATED ART
FIG. 2 depicts a block diagram of a driving apparatus of a conventional plasma display panel.
Figure 3:
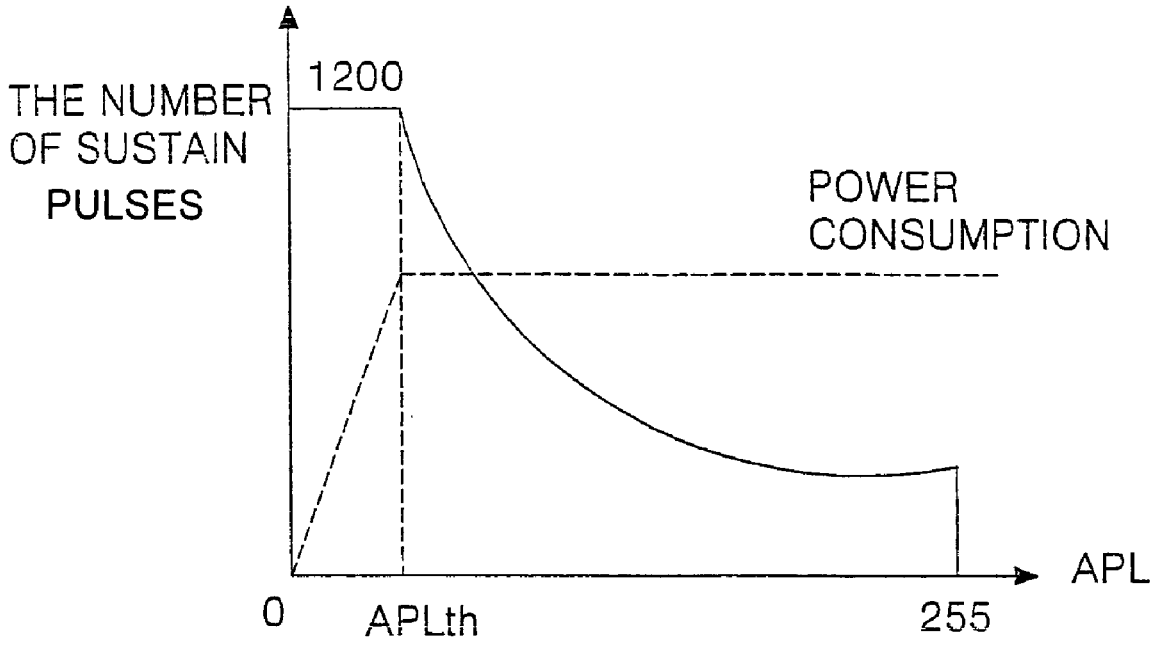
FIG. 3 RELATED ART
FIG. 3 is a graph conventionally representing the number of sustaining pulses in accordance with APL steps.
Figure 4:
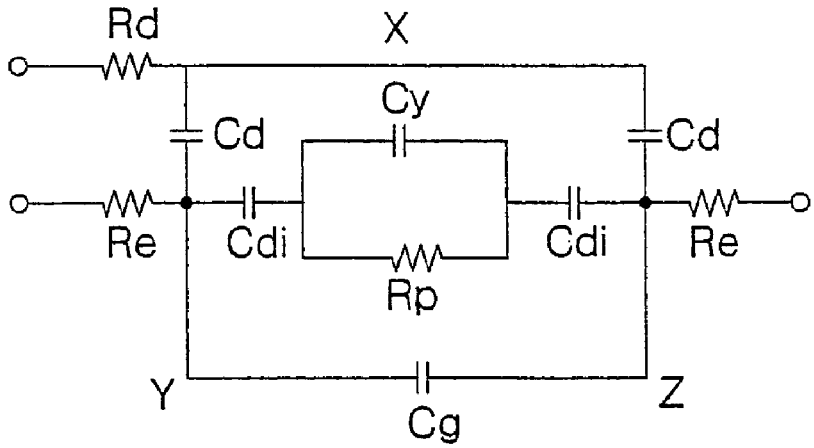
FIG. 4 RELATED ART
FIG. 4 is a circuit diagram equivalently representing a discharge cell shown in FIG. 1.
Figure 5:
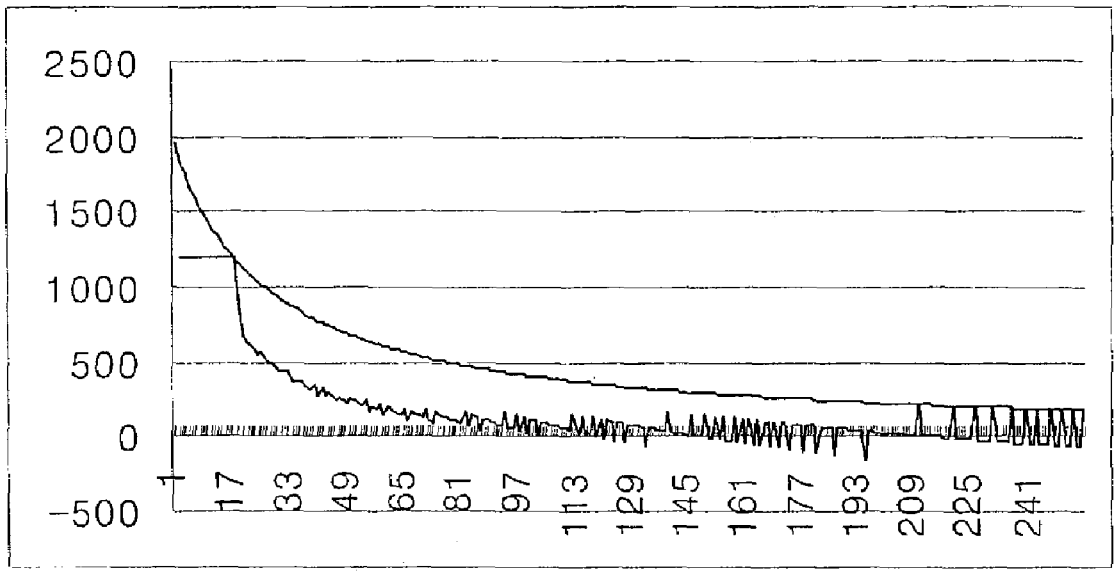
FIG. 5 RELATED ART
FIG. 5 is a graph conventionally representing a brightness inversion phenomenon in according with APL steps.
Figure 6:
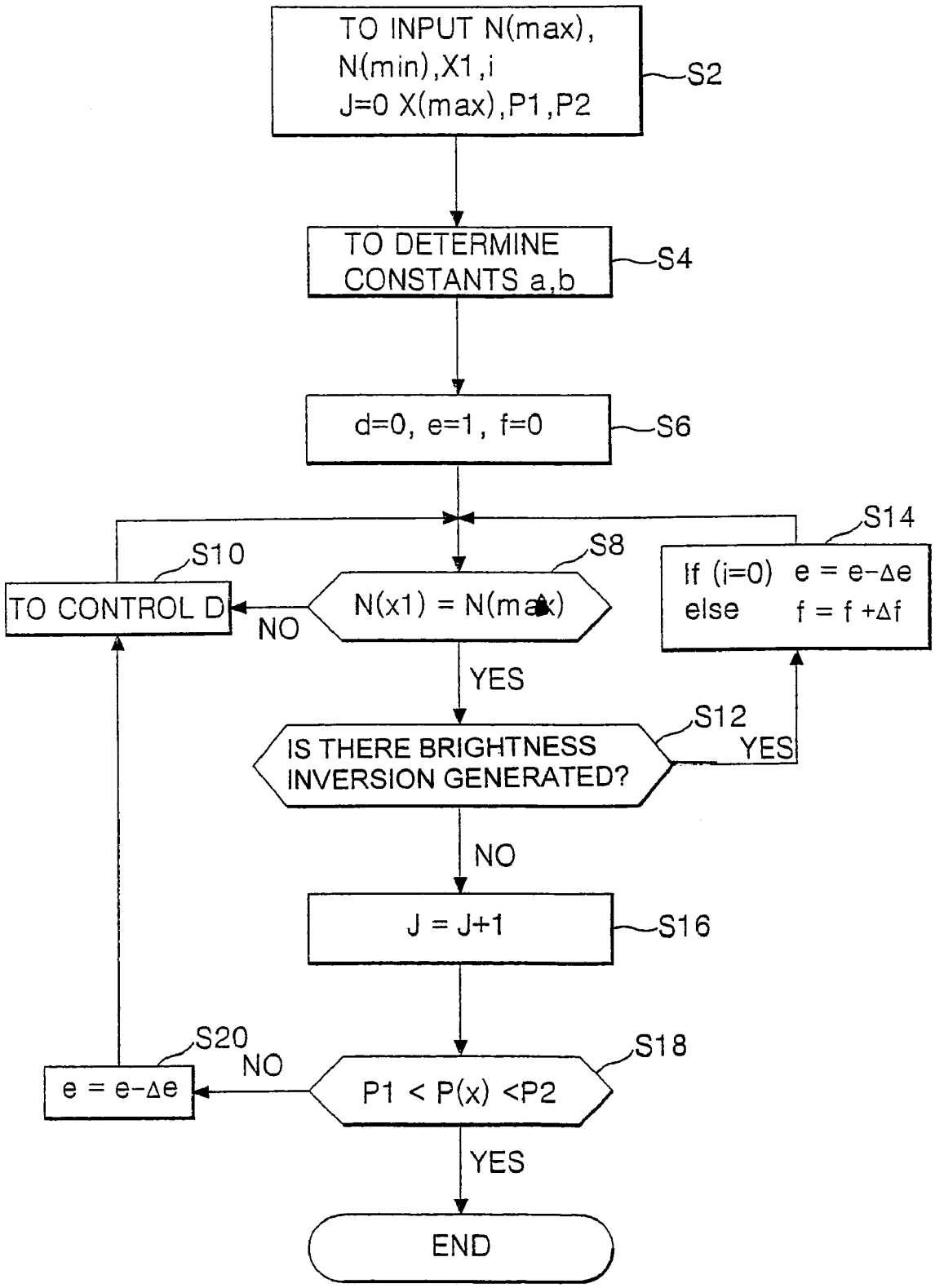
FIG. 6 depicts a flow chart of the process of calculating a high brightness intensifying coefficient, a low brightness intensifying coefficient and an average increase constant.

FIG. 6 is a flow chart representing a method of determining constants d, e and f shown in Equation 6.

Referring to FIG. 6, firstly, a maximum sustain number N (max), an APL threshold (x1), a minimum sustain number N (min) and APL's maximum step value X(max) are inputted. Further, a minimum power value P1 and a maximum power value P2 of a sustain power supply, a constant j with a value of 0, and i having half of a maximum gray scale value (herein 128) are inputted.

The minimum power value P1 and the maximum power value P2 inputted in a step S2 is determined as ±15% of an average power value of the sustain power supply. For example, if the average power value of the sustain power supply is 100, the minimum power value P1 is set to be 85, the maximum power value P2 is set to be 115. Practically, the minimum power value P1 and the maximum power value P2 may be set within ±5~±25% of the average power value in the present invention.

The maximum sustain number N(max), the APL threshold (x1), the minimum sustain number N(min) and APL's maximum step value X(max) inputted in the step S2 are substituted for the variables in Equation 1 to obtain the values of the constant a and b. (S4)

After obtaining the values of the constant a and b in the step S4, the constants d, e and f are set to be 0, 1 and 0 respectively, i.e., d=0, e=1 and f=0. (S6) After certain values are substituted for the constants d, e and f in the step S6, it is checked in use of Equation 5 and 6 whether the maximum sustain number N (max) satisfies the value inputted in the step S2 when the APL threshold (x1) is substituted for the variable; herein, assuming that the maximum sustain number N(max) is 1200. (S8)

When the APL threshold (x1) is substituted for the variable in the step S8, if the maximum sustain number N(max) is not satisfied, the value of the constant d is made to increase by one. (S10) After then, the steps S8 and S10 are repeated to have the maximum sustain number N(max) when the APL threshold (x1) is substituted for the variable.

It is checked whether the brightness inversion phenomenon is generated if the maximum sustain number N(max) is obtained when the APL threshold (x1) is substituted for the variable in the step S8. (S12) Equation 3 is used to check the brightness inversion phenomenon.

The value of the constant e is made to increase by one if there occurs the brightness inversion phenomenon in the step S12 (at this moment, j=0). (S14) The steps S8 through S14 are repeated until no brightness inversion phenomenon occurs.

If no brightness inversion phenomenon occurs in the step S12, the value of the constant j inputted in the step S2 is made to increase by one. (S16) After then, it is checked whether the consumed power value of the PDP is positioned between the minimum power value P1 and the maximum power value P2 inputted in the step S2 while sequentially increasing the APL step. (S18)

If the value of the power consumed in the PDP in the step S18 is not positioned between the minimum power value P1 and the maximum power value P2, the value of the constant e is made to decrease. (S20) After decreasing the value of the constant e in the step S20, the constant d is made to increase in the step S10. (S10) After then, the steps S8 and S12 are repeated. (S8, S12)

It is checked whether the brightness inversion occurs in the step S12 and if the brightness is inverted, it is inputted to the step S14. (S12) In the step S14, it is checked whether the constant j is equal to the value of 0, if the constant j has the value of 0 or more, the constant f is made to increase by the value below decimal point; increment by 0.01. (S14) After then, the steps S8 through S20 are repeated until the value of the power consumed in the PDP is positioned between the minimum power value P1 and the maximum power value P2.

On the other hand, in the step S18, if the power value consumed in the PDP is positioned between the minimum power value P1 and the maximum power value P2, the constant values calculated up to this point of time are substituted into Equation 5 and 6 to calculate the number of sustain pulses.

For instance, when the maximum sustain number is set to be 1200, the minimum sustain number 200, the threshold of APL 26 and the maximum step of APL 255, the constants are set like {$a=4.9\times10^{-4}$, $b=1.96\times10^{-5}$, d=10400, e=60 and f=0.35}.

Figure 7:
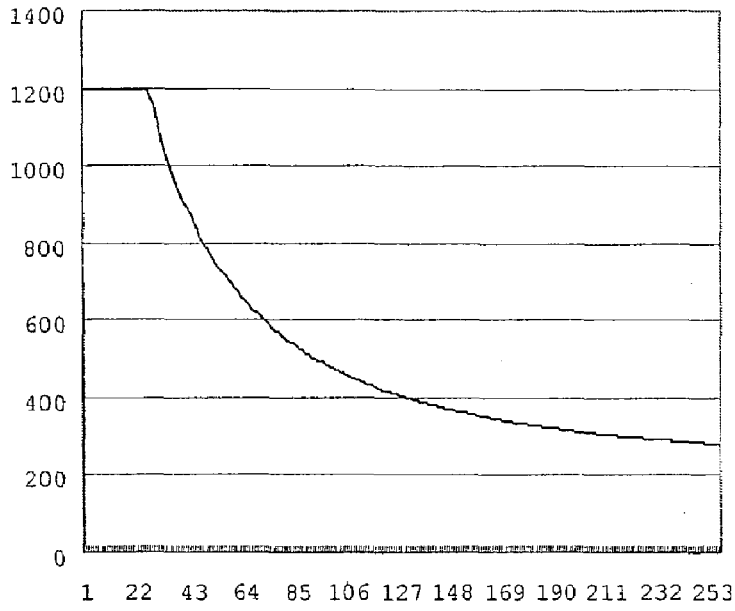
FIG. 7 is a graph representing the number of sustaining pulses in accordance with APL steps determined by Equation 5 and 6.
Figure 8:
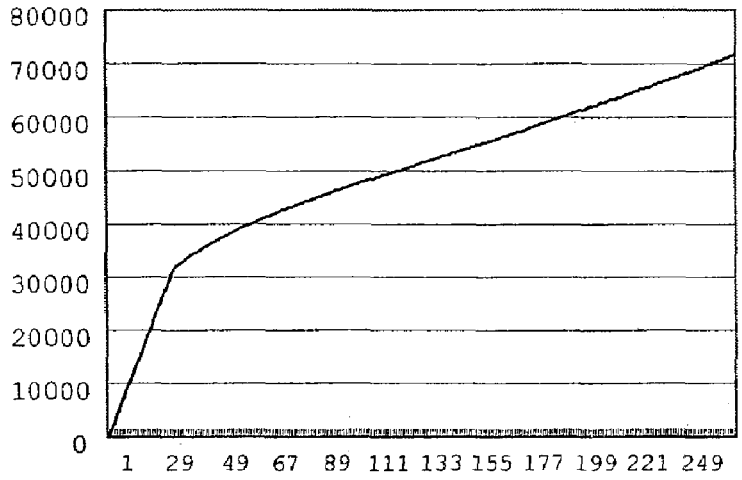
FIG. 8 is a graph representing brightness values defined by Equation 5 and 6.

On the other hand, if the values of the foregoing a, b, d, e and f are substituted into Equation 5 and 6, it can be seen that the number of sustain pulses slowly decrease after the threshold of APL as in FIG. 7. Further, the brightness value checked by Equation 3 increases in proportion to the APL steps as in FIG. 8.

Figure 9:
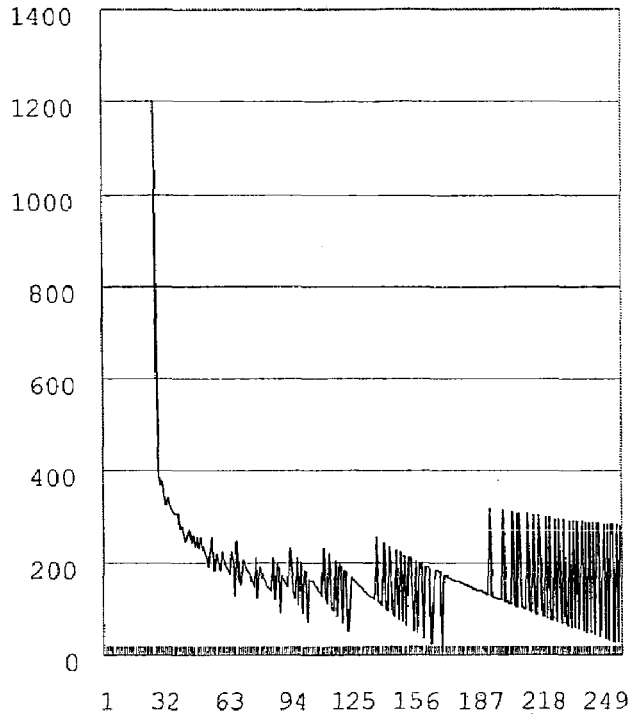
FIG. 9 is a graph representing values obtained by subtracting the brightness value of a previous APL step from the brightness value of a current APL step.

In addition, when the brightness of B(x)−B(x−1); herein, x is a natural number of 1 or more, is calculated, it is shown as in FIG. 9.

FIG. 9 is a graph representing values obtained by subtracting the brightness value of a previous APL step from the brightness value of a current APL step.

Referring to FIG. 9, there is no area where brightness is inverted according to a method of setting an average picture level of the embodiment of the present invention. In other words, there is no area where the value of B(x)+B(x−1) is 0 or less. Accordingly, it is possible according to the method of setting the average picture level of the present invention that flickers are eliminated and a picture quality is improved.

Figure 10:
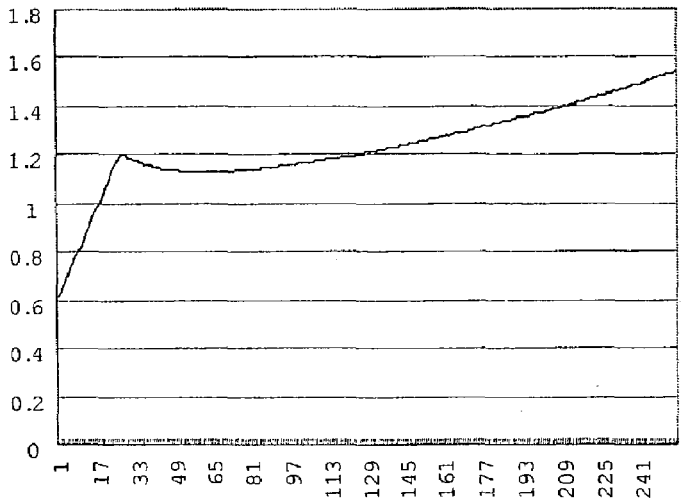
FIG. 10 is a graph representing power consumption in accordance with APL steps.

On the other hand, it can be seen that the power consumed in the PDP is sustained uniformly within ±15% as in FIG. 10.

Equation 5 and 6 according to the embodiment of the present invention is derived through the process as follows.

The following expression is to be satisfied by Equation 2 and 3 in order to satisfy P1<P (x)<P2 (herein, P1 is minimum power value, P2 maximum power value) and B(x)>(Bx−1) in an arbitrary APL level x.

$$P1/(a+bx)<N\mathrm{sus}(x)<P2/(a+bx)$$

The number of sustain pulses satisfying the above expression is determined like Equation 5. A calculation of brightness can be done using Equations 5 and 3, as follows.

$$B(x)=x\times N\mathrm{sus}(x)=(x/(a+bx))\times n(x) \qquad \text{[Equation 7]}$$

A differential function B' (x) in relation to x in Equation 7 is as follows.

$$B'(x)=an(x)/(a+bx)^2+xn(x)/(a+bx)=\epsilon(x)>0 \qquad \text{[Equation 8]}$$

If Equation 8 is converted as follows $$n(x)+\{a/x(a+bx)\}\times n(x)\equiv n(x)+p(x)n(x)=\epsilon(x)\times\{(a+bx)/x\}\equiv q(x)$$

At this moment, the solution of the differential equation is as follows.

$$n(x)=\exp\left(-\int P(x)dx\right)\left[\int q(x)\mathrm{exP}\left(\int p(x)dx+C\right)\right]$$

Herein, $$\int p(x)dx=\int\{a/x(a+bx)\}dx=-ln\{(a+bx)/x\}$$

Since the above equation is given, N(x) is expressed as follows.

$$n(x)=\{(a+bx)/x\}[\int\epsilon(x)dx+C]$$

Herein, assuming that it is given in a series form of $\epsilon(x)=d/x+e+2fx$ (d, e and f are constants), N(x) is expressed as follows.

$$n(x)=\{(a+bx)/x\}\times(C+dln(x)+ex+fx^2)$$

Herein, a constant C does not much affect a brightness increase rate. Accordingly, if the constant C is included in e and f, Equation 6 is derived.

As described above, according to the method of setting the average picture level of the present invention, it is possible to prevent the brightness inversion phenomenon in setting the number of sustain in accordance with APL. By preventing such brightness inversion phenomenon, it is possible to prevent flickers generated in the plasma display panel and to provide a good picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of setting an average picture level, comprising:

setting an average picture level with a fixed number of steps on the basis of a pre-determined gray level range;

deriving a low brightness intensifying coefficient from a low brightness range of steps that are not greater than a middle step of the average picture level in order to correct a linearity of brightness;

deriving a high brightness intensifying coefficient from a high brightness range of steps that are equal to or not less than the middle step in order to correct a brightness inversion phenomenon;

deriving a first constant representing an average increase rate of brightness in relation to an increase of the average picture level when a current average picture level increases as compared to a previous average picture level; and calculating the number of sustain pulses corresponding to a gray level of a video signal currently inputted based on the derived low brightness intensifying coefficient, the high brightness intensifying coefficient and the first constant.

2. The method according to claim 1, further comprising:

setting a maximum sustain pulse number and a minimum sustain pulse number.

3. The method according to claim 2, further comprising:

setting a second constant and a third constant based on the following Formula 1 after receiving a threshold of average picture level that makes the maximum sustain pulse number sustained uniformly, the minimum sustain number and a maximum step value of the average picture level:

$$N=1/(a+b\times x1) \quad \text{Formula 1}$$

Herein, N is the maximum sustain pulse number of the minimum sustain pulse number, a is the second constant, b is the third constant and x1 is the threshold or the maximum step value.

4. The method according to claim 3, wherein the sustain pulse number is determined by the following Formulas 2 and 3:

$$N\text{sus}(x)=n(x)/(a+bx) \quad \text{Formula 2}$$

$$N(x)=((a+bx)/x)\times[d\times ln(x)+e(x-i)+f(x-i)^2] \quad \text{Formula 3}$$

Herein, x is the current average picture level, Nsus(x) is the number of sustain pulses determined by the current average picture level, d is the low brightness intensifying coefficient, e is the first constant, f is the high brightness intensifying coefficient and i is the middle step of the average picture level.

5. The method according to claim 4, further comprising:

setting a maximum power value and a minimum power value of a plasma display panel based on an average power value of a power supply for supplying electric power.

6. The method according to claim 5, wherein the maximum power value is obtained by adding the average power value and 5%~25% of the average power value.

7. The method according to claim 6, wherein the minimum power value is obtained by subtracting 5%~25% of the average power value from the average power value.

8. The method according to claim 7, further comprising inputting the lower intensifying coefficient d, the first constant e and the higher intensifying coefficient f, which are pre-determined, into the Formulas 2 and 3; and increasing the low brightness intensifying coefficient by "1" until it satisfies the maximum sustain pulse number after inserting the threshold of the average picture level into the Formulas 2 and 3.

9. The method according to claim 8, wherein the first constant is made to increase by "1" until a high brightness value is obtained in a high average picture level if the maximum sustain pulse number is satisfied when the threshold of the average picture level is inputted into the Formulas 2 and 3.

10. The method according to claim 9, wherein the value of the first constant is made to decrease by "1" and the low brightness intensifying coefficient is made to increase by "1" in order to allow a power value currently consumed in the plasma display panel to be positioned between the maximum power value and the minimum power value.

11. The method according to claim 9, wherein the value of the high brightness intensifying coefficient is made to increase by "0.01" until the high brightness value is obtained in the high average picture level after the first constant and the low brightness intensifying coefficient are adjusted.

12. The method according to claim 4, wherein the low brightness intensifying coefficient, the first constant and the high brightness intensifying coefficient are substituted into the Formulas 2 and 3, and determined if they satisfy the following Conditions 1, 2 and 3:

$$N(x2)=N(\max) \quad \text{Condition 1}$$

Herein, N(x2) is the threshold of the average picture level and N(max) is the maximum sustain pulse number;

$$B(x)-(Bx-1)>0 \quad \text{Condition 2}$$

Herein, B(x) is a brightness value of the current average picture level, B(x−1) is a brightness value of the previous average picture level; and $$P1<P(x)<P2 \quad \text{Condition 3}$$

Herein, P1 is a minimum power value, P2 is a maximum power value and P(x) is a power value of the current average picture level.

13. The method according to claim 12, wherein the first constant and the high brightness intensifying coefficient are set to be minimum values that satisfy the Conditions 1 to 3.

14. A method of driving a plasma display panel, comprising steps of:

detecting a value of a current average picture level;

subtracting a middle value of an average picture level from the value of the current average picture level; and calculating the number of sustain pulses based on the subtracted middle value from the value of the current average picture level and applying the calculated number of the sustain pulses to the plasma display panel, wherein applying the calculated number of the sustain pulses avoids a brightness inversion phenomenon.

15. A method comprising:

determining a low brightness intensifying coefficient from a low brightness range of steps;

determining a high brightness intensifying coefficient from a high brightness range of steps;

determining a first constant representing an average increase rate of brightness when a current average picture level increases as compared to a previous average picture level; and calculating a number of sustain pulses based on the determined low brightness intensifying coefficient, the determined high brightness intensifying coefficient and the determined first constant.

16. The method according to claim 15, further comprising applying the calculated number of sustain pulses to a plasma display panel.

17. The method according to claim 15, further comprising:

setting a maximum sustain pulse number and a minimum sustain pulse number.

18. The method according to claim 17, further comprising:

setting a second constant and a third constant based on the following Formula 1 after reaching a threshold of the average picture level that makes the maximum sustain pulse number uniformly sustained, the minimum sustain number and a maximum step value of the average picture level;

$$N=1/(a+b\times x1) \quad \text{Formula 1}$$

wherein, N is the maximum sustain pulse number of the minimum sustain pulse number, a is the second constant, b is the third constant and x1 is the threshold or the maximum step value.

19. The method according to claim 18, wherein the sustain pulse number is determined by the following Formulas 2 and 3:

$$N\text{sus}(x)=n(x)/(a+bx) \quad \text{Formula 2}$$

$$N(x)=((a+bx)/x)\times[d\times ln(x)+e(x-i)+f(x-i)^2] \quad \text{Formula 3}$$

wherein, x is the current average picture level, Nsus(x) is the number of sustain pulses determined by the current average picture level, d is the low brightness intensifying coefficient, e is the first constant, f is the high brightness intensifying coefficient and i is the middle step of the average picture level.

20. The method according to claim 19, further comprising:

increasing the low brightness intensifying coefficient by "1" until it satisfies the maximum sustain pulse number after inserting the threshold of the average picture level into the Formulas 2 and 3.

21. The method according to claim 20, wherein the first constant is made to increase by "1" until a high brightness value is obtained in a high average picture level if the maximum sustain pulse number is satisfied when the threshold of the average picture level is inputted into the Formulas 2 and 3.

22. The method according to claim 21, wherein the value of the first constant is made to decrease by "1" and the low brightness intensifying coefficient is made to increase by "1" in order to allow a power value currently consumed in the plasma display panel to be positioned between the maximum power value and the minimum power value.

23. The method according to claim 21, wherein the value of the high brightness intensifying coefficient is made to increase by "0.01" until the high brightness value is obtained in the high average picture level after the first constant and the low brightness intensifying coefficient are adjusted.

24. The method according to claim 19, wherein the low brightness intensifying coefficient, the first constant and the high brightness intensifying coefficient are substituted into the Formulas 2 and 3, and are determined if they satisfy the following Conditions 1, 2 and 3:

$$N(x2)=N(\max) \quad \text{Condition 1}$$

wherein, N(x2) is the threshold of the average picture level and N(max) is the maximum sustain pulse number;

$$B(x)-(Bx-1)>0 \quad \text{Condition 2}$$

wherein, B(x) is a brightness value of the current average picture level, B(x−1) is a brightness value of the previous average picture level; and $$P1<P(x)<P2 \quad \text{Condition 3}$$

wherein, P1 is a minimum power value, P2 is a maximum power value and P(x) is a power value of the current average picture level.

25. The method according to claim 24, wherein the first constant and the high brightness intensifying coefficient are set to be minimum values that satisfy the Conditions 1 to 3.

* * * * *